US009897938B2

(12) United States Patent
Koshizuka et al.

(10) Patent No.: US 9,897,938 B2
(45) Date of Patent: Feb. 20, 2018

(54) DEVELOPING DEVICE AND IMAGE FORMING APPARATUS INCORPORATING SAME

(71) Applicants: Shinnosuke Koshizuka, Kanagawa (JP); Koichi Yamazaki, Kanagawa (JP); Tatsuya Kubo, Kanagawa (JP); Atsushi Nakamoto, Kanagawa (JP); Nobuo Takami, Kanagawa (JP); Kazunori Suzuki, Kanagawa (JP); Naohiro Kawashima, Kanagawa (JP)

(72) Inventors: Shinnosuke Koshizuka, Kanagawa (JP); Koichi Yamazaki, Kanagawa (JP); Tatsuya Kubo, Kanagawa (JP); Atsushi Nakamoto, Kanagawa (JP); Nobuo Takami, Kanagawa (JP); Kazunori Suzuki, Kanagawa (JP); Naohiro Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/368,924

(22) Filed: Dec. 5, 2016

(65) Prior Publication Data

US 2017/0168421 A1 Jun. 15, 2017

(30) Foreign Application Priority Data

Dec. 9, 2015 (JP) ..... 2015-240175

(51) Int. Cl.
*G03G 15/08* (2006.01)

(52) U.S. Cl.
CPC ..... *G03G 15/0881* (2013.01); *G03G 15/081* (2013.01); *G03G 15/0817* (2013.01)

(58) Field of Classification Search
None
See application file for complete search history.

(56) References Cited

U.S. PATENT DOCUMENTS

2002/0090226 A1* 7/2002 Sato ..... G03G 15/0817 399/103
2009/0041508 A1* 2/2009 Oshikawa ..... G03G 15/0844 399/254

(Continued)

FOREIGN PATENT DOCUMENTS

JP 2014-134651 7/2014
JP 2015-222315 12/2015

OTHER PUBLICATIONS

JP 2014134651 English machine translation, Koshizuka et al., Jul. 24, 2014.*

*Primary Examiner* — Thomas Giampaolo, II
(74) *Attorney, Agent, or Firm* — Oblon, McClelland, Maier & Neustadt, L.L.P.

(57) ABSTRACT

A developing device includes a developer bearer to carry, by rotation, developer to a developing range, a casing including a developer container to contain the developer and housing the developer bearer, a gap retainer adjacent to the developer container and downstream from the developing range in a rotation direction of the developer bearer, an opposing wall opposing an end face of the gap retainer in an axial direction of the developer bearer, a first seal disposed between the end face of the gap retainer and the opposing wall, and a contact portion disposed adjacent to an end portion of the gap retainer in the axial direction of the developer bearer. The gap retainer secures a predetermined gap between the developer bearer and the gap retainer. The contact portion contacts, via a second seal, the gap retainer in a direction intersecting the axial direction of the developer bearer.

10 Claims, 11 Drawing Sheets

(56) References Cited

U.S. PATENT DOCUMENTS

| | | | | |
|---|---|---|---|---|
| 2012/0163875 | A1 | 6/2012 | Tateyama et al. | |
| 2012/0219326 | A1 | 8/2012 | Koike et al. | |
| 2013/0028630 | A1* | 1/2013 | Ito | G03G 15/0817 399/103 |
| 2013/0034368 | A1 | 2/2013 | Hattori et al. | |
| 2013/0315636 | A1 | 11/2013 | Takayama et al. | |
| 2014/0003843 | A1 | 1/2014 | Suzuki et al. | |
| 2014/0376951 | A1 | 12/2014 | Ogawa et al. | |
| 2015/0023700 | A1 | 1/2015 | Nakamoto et al. | |
| 2015/0139671 | A1 | 5/2015 | Matsumoto et al. | |
| 2015/0338824 | A1* | 11/2015 | Shimizu | G03G 21/1676 399/270 |
| 2016/0070208 | A1 | 3/2016 | Kikuchi et al. | |
| 2016/0195846 | A1 | 7/2016 | Koshizuka et al. | |

* cited by examiner

DEVELOPING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2015-240175, filed on Dec. 9, 2015, in the Japan Patent Office, the entire disclosure of which is hereby incorporated by reference herein.

BACKGROUND

Technical Field

Embodiments of the present invention generally relate to a developing device and an image forming apparatus, such as a copier, a printer, a facsimile machine, or a multifunction peripheral having at least two of copying, printing, facsimile transmission, plotting, and scanning capabilities, that includes the developing device.

Description of the Related Art

There are developing devices including a casing storing developer and a developer bearer that carries and conveys the developer stored in the casing to a developing region opposing to a latent image bearer.

SUMMARY

An embodiment of the present invention provides a developing device that includes a developer bearer to carry, by rotation, developer to a developing range facing a latent image bearer; a casing including a developer container to contain the developer and housing the developer bearer; a gap retainer disposed adjacent to the developer container and downstream from the developing range in a rotation direction of the developer bearer, to secure a predetermined gap between a surface of the developer bearer and the gap retainer; an opposing wall opposing an end face of the gap retainer in an axial direction of the developer bearer; a first seal disposed between the end face of the gap retainer and the opposing wall; and a contact portion disposed adjacent to an end portion of the gap retainer adjacent to the end face. The contact portion contacts, via a second seal, the gap retainer in a direction intersecting the axial direction of the developer bearer.

In another embodiment, an image forming apparatus includes a latent image bearer to bear a latent image, and the above-described developing device to develop the latent image with the developer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
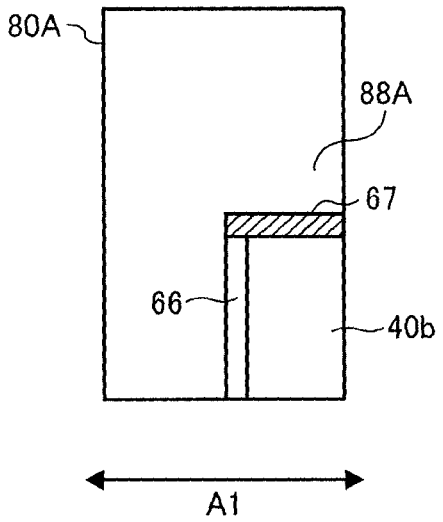
FIG. 1A is a schematic diagram illustrating a seal structure adjacent a front plate of a developing device according to an embodiment, viewing from a photoconductor.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
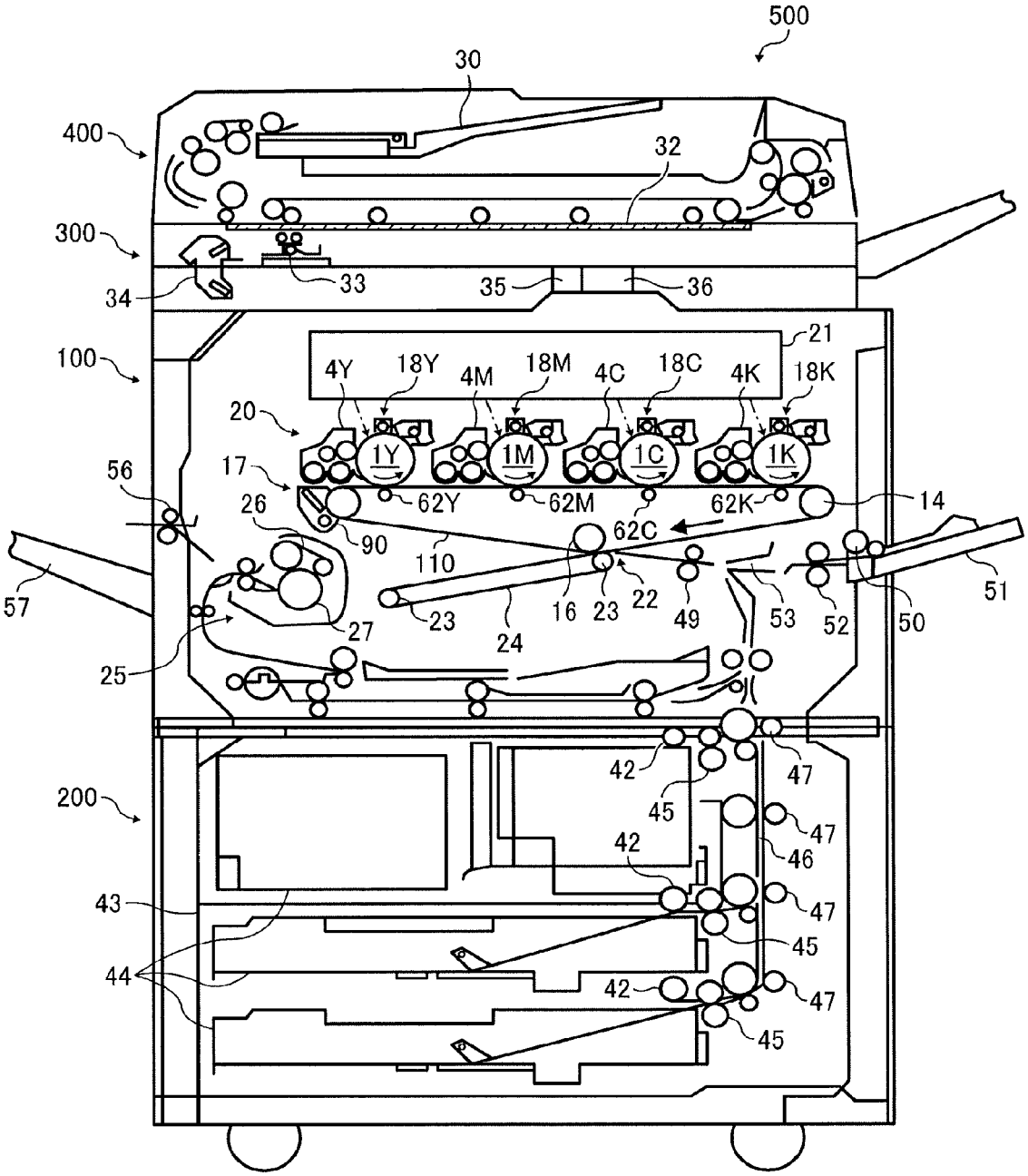
FIG. 2 is a schematic diagram illustrating an image forming apparatus according to an embodiment.

Referring now to the drawings, wherein like reference numerals designate identical or corresponding parts throughout the several views thereof, and particularly to FIG. 2, an image forming apparatus according to an embodiment of the present invention is described.

FIG. 2 is a schematic diagram illustrating a configuration of an image forming apparatus according to the present embodiment.

For example, the image forming apparatus illustrated in FIG. 2 is a tandem-type multicolor laser copier and includes multiple photoconductors arranged side by.

An image forming apparatus 500 illustrated in FIG. 2 includes a printer body 100, a sheet feeder 200 on which the printer body 100 is mounted, and a scanner 300 secured on the printer body 100. The image forming apparatus 500 further includes an automatic document feeder (ADF) 400 mounted on the scanner 300.

The printer body 100 includes a tandem unit 20 including four process cartridges 18Y, 18M, 18C, and 18K (also collectively "process cartridges 18") for forming yellow (Y), magenta (M), cyan (C), and black (K) images. It is to be noted that suffixes Y, C, M, and K attached to each reference numeral indicate only that components indicated thereby are used for forming yellow, cyan, magenta, and black images, respectively, and hereinafter may be omitted when color discrimination is not necessary. The image forming apparatus 500 further includes an optical writing unit 21, an intermediate transfer unit 17, a secondary transfer device 22, a registration roller pair 49, and a belt-type fixing device 25. The optical writing unit 21 includes a light source, a polygon mirror, an f-θ lens, and reflection mirrors, and is configured to emit laser beams onto the surfaces of photoconductors according to image data.

Figure 3:
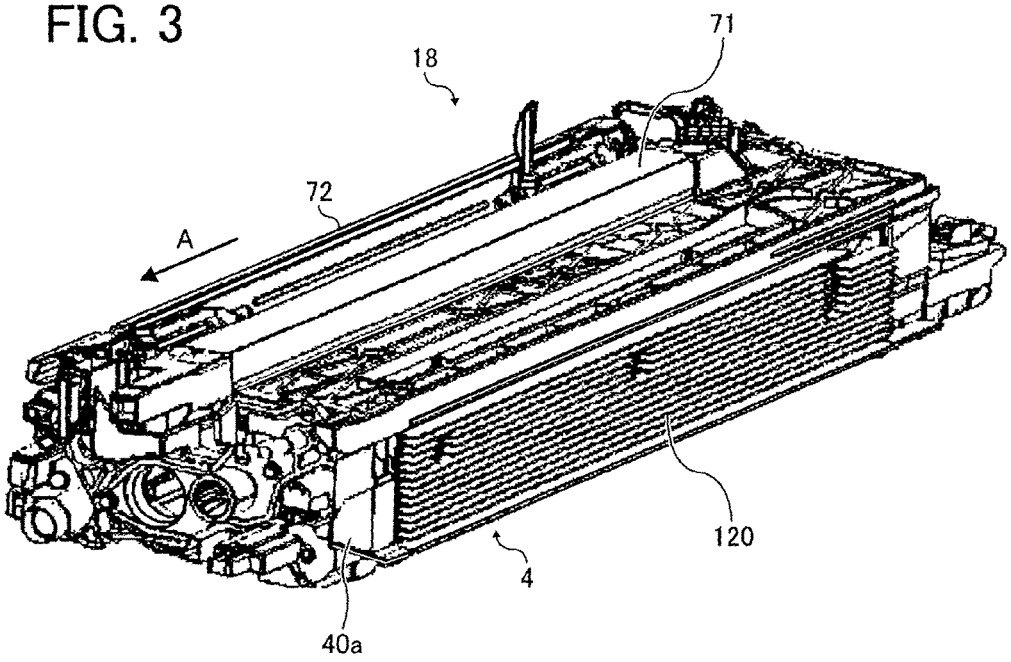
FIG. 3 is a perspective view of the back side of a process cartridge according to an embodiment.
Figure 4:
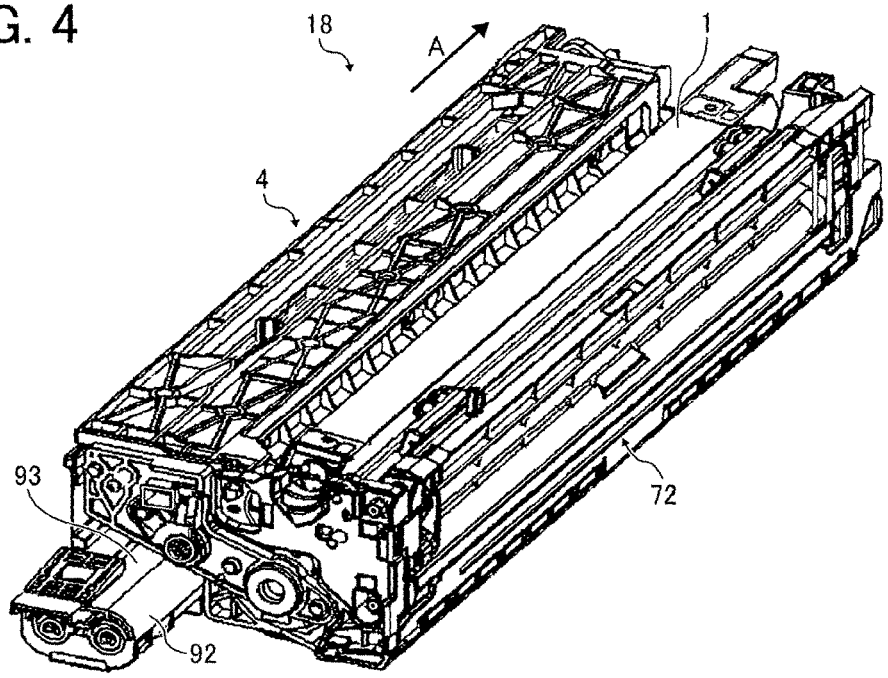
FIG. 4 is a perspective view of the front side of the process cartridge illustrated in FIG. 2.

FIG. 3 is a perspective view of the process cartridge 18 as viewed from the back side, and FIG. 4 is a perspective view of the process cartridge 18 as viewed from the front side.

The process cartridges 18 have a similar configuration, and therefore the subscripts Y, C, M, and Bk for color discrimination are omitted when the configuration and operation of the process cartridges 18 are described. Each of the process cartridges 18 is inserted into a space inside the printer body 100 from the front side to the back side as indicated by arrow A in FIGS. 3 and 4, and mounted therein. The process cartridge 18 includes a drum-shaped photoconductor 1, a drum cleaning device 72, a charging device 71, and a developing device 4 (4Y, 4M, 4C, or 4K) disposed around the photoconductor 1. On a side face of a casing 40, in which a developer containing compartment 40*a* (i.e., a developer container) is defined, of the developing device 4, a heat dissipating part 120 is disposed. The heat dissipating part 120 serves as a cooler to cool the developer containing compartment 40*a*.

Figure 5:
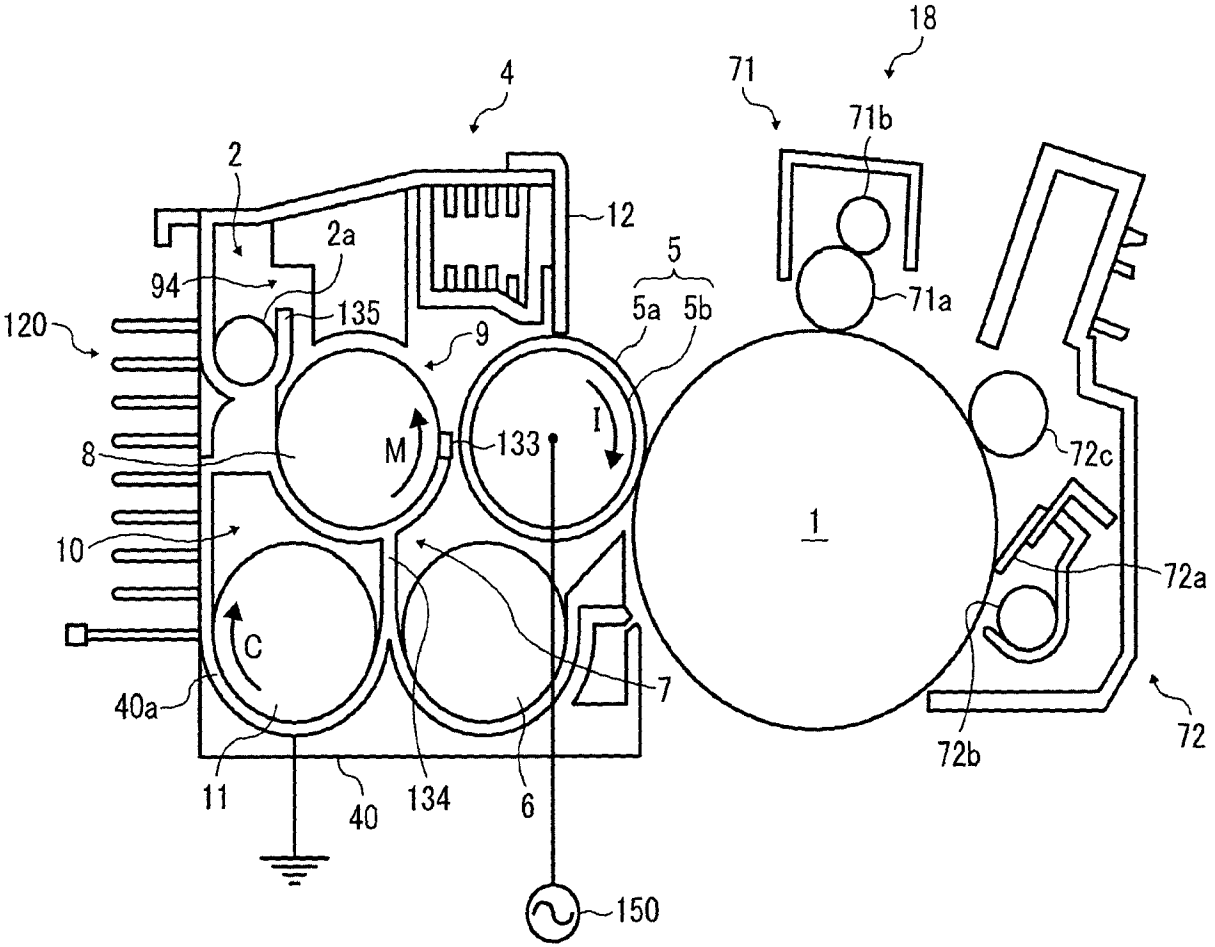
FIG. 5 is a schematic cross-sectional view illustrating the process cartridge.

FIG. 5 is a schematic view of the process cartridge 18.

As illustrated in FIG. 5, the drum cleaning device 72 mainly includes a cleaning blade 72*a*, which is elastic and long in the axial direction, and a discharge screw 72*b*. A long side (contact side or an edge portion) of the cleaning blade 72*a* is pressed against the surface of the photoconductor 1 to remove substances, such as residual toner, from the surface of the photoconductor 1. The discharge screw 72*b* discharges the removed toner outside drum cleaning device 72. The drum cleaning device 72 further includes a charge remover 72*c* to which direct voltage is applied. The charging device 71 includes a charging roller 71*a* disposed to abut the photoconductor 1 and a charging roller cleaner 71*b* that rotates while abutting the charging roller 71*a*.

The developing device 4 includes a developing roller 5 and the casing 40, in which the developer containing compartment 40*a* is defined. The casing 40, a front plate 80A illustrated in FIG. 7, and a back plate 80B illustrated in FIG. 9 together form a box-like developing device casing.

The developer containing compartment 40*a* contains two-component developer including toner and carrier. The developing roller 5, serving as a developer bearer, supplies the toner to an electrostatic latent image on the photoconductor 1 while rotating in the direction indicated by arrow I in FIG. 5. Although two-component developer including toner and carrier is used in the present embodiment, one-component developing may be employed as long as the developer is magnetically borne on a developer bearer. The developing roller 5 includes a cylindrical developing sleeve 5*a* made of a nonmagnetic material and a magnet roller 5*b* disposed inside the developing sleeve 5*a*. The developing sleeve 5*a* rotates around the magnet roller 5*b*, and the magnet roller 5*b* includes multiple stationary magnets. As the developing sleeve 5*a* rotates around the magnet roller 5*b* that generates multiple magnetic poles, developer moves along the circumference (in the direction of arc) of the developing roller 5.

With a developing bias applied from a power source 150 to the developing sleeve 5*a*, a developing electrical field is generated between the developing sleeve 5*a* and the photoconductor 1 in the developing range. With the development field, the toner in developer carried on the surface of the developing sleeve 5*a* is supplied to the latent image on the surface of the photoconductor 1, developing it. In the present embodiment, an AC (alternating current) bias is applied to the developing sleeve 5*a* as the developing bias, and the peak voltage of the AC bias is greater than or equal to 1 kV. Compared with a direct-current (DC) bias, the AC bias as the developing bias can increase the amount of toner parting from carrier, thus improving the developing capability. Then, sharp images can be produced.

The developing device 4 further includes a supply screw 8 disposed opposite the developing roller 5 to supply toner thereto and a developer doctor 12 disposed downstream from an area opposing the supply screw 8 in the rotation direction of the developing roller 5. The developer doctor 12, serving as a developer regulator, regulates the developer supplied to the developing roller 5 to a desired or given thickness. The developer containing compartment 40*a* includes a first partition 133 and a second partition 134. The first partition 133 and the second partition 134 partition the developer containing compartment 40*a* into a collecting compartment 7, a supply compartment 9, and a stirring compartment 10.

The supply screw 8 is disposed in the supply compartment 9 to transport the developer in the axial direction thereof to the front side of the paper on which FIG. 5 is drawn, while supplying the developer to the developing roller 5. The supply screw 8 is a developer conveyor and includes a shaft and a blade projecting from the shaft to transport the developer axially by rotation. The collecting compartment 7 is disposed downstream in the direction of rotation of the developing roller 5 from the developing range where the developing roller 5 faces the photoconductor 1. The developer that has passed through the developing range falls to the collecting compartment 7 and collected therein. A collecting screw 6 is disposed in the collecting compartment 7. The collecting screw 6 transports the developer in the direction identical to the direction in which the supply screw 8 transports the developer (hereinafter "developer conveyance direction"). The developing roller 5 and the supply compartment 9 in which the supply screw 8 is disposed are arranged laterally, and the collecting compartment 7 in which the collecting screw 6 is disposed is below the developing roller 5.

The stirring compartment 10 is below the supply compartment 9 and on a side of the collecting compartment 7. Disposed in the stirring compartment 10 is a stirring screw 11 that transports the developer to the back side of the paper on which FIG. 5 is drawn, while stirring the developer. The direction in which the stirring screw 11 transports the developer is opposite the developer conveyance direction of the supply screw 8. The first partition 133 separates, at least partly, the supply compartment 9 from the stirring compartment 10. Although separated by the first partition 133, the supply compartment 9 and the stirring compartment 10 communicate with each other in both end portions in the direction perpendicular to the surface of paper on which FIG. 5 is drawn, through openings 133*a* (illustrated in FIG. 10). It is to be noted that the supply compartment 9 and the collecting compartment 7 are separated by the first partition 133 as well, and the first partition 133 does not include an opening to allow the supply compartment 9 to communicate with the collecting compartment 7. Additionally, the stirring compartment 10 and the collecting compartment 7 are partitioned with the second partition 134. Although separated by the second partition 134, an opening 134*a* (illustrated in FIG. 10) is secured on the downstream side of the developer conveyance direction by the collecting screw 6 to allow the stirring compartment 10 to communicate with the collecting compartment 7.

The supply compartment 9 includes a developer outlet 94 to discharge a part of developer contained therein when the level of the developer in the supply compartment 9 exceeds a predetermined level. The developer discharged from the developer outlet 94 is transported through a discharge passage 2 to the outside of the developing device 4, and a discharge screw 2*a* is disposed in the discharge passage 2. The discharge passage 2 is adjacent, via a partition 135, to the supply compartment 9 on the downstream side of the supply compartment 9 in the developer conveyance direction therein. The developer outlet 94 is an opening in the partition 135 to allow the supply compartment 9 to communicate with the discharge passage 2.

The charging device 71 uniformly charges the surface of the photoconductor 1. Then, the optical writing unit 21 directs the laser beam, which is modulated and deflected, to the charged surface of the photoconductor 1. The laser beam (exposure light) attenuates the electrical potential of the portion of the photoconductor 1 thus exposed, forming an electrostatic latent image thereon. Then, the developing device 4 develops the electrostatic latent image on the photoconductor 1 into a toner image. The toner image is primarily transferred from the photoconductor 1 onto an intermediate transfer belt 110. Subsequently, the cleaning blade 72*a* of the drum cleaning device 72 removes toner remaining on the surface of the photoconductor 1. Further, the charge remover 72*c* removes electrical potential remaining on the photoconductor 1, after which the charging device 71 uniformly charges the surface of the photoconductor 1. Thus, the photoconductor 1 is initialized.

The above-described processes are similar in the process cartridges 18Y, 18M, 18C, and 18K.

Next, the intermediate transfer unit 17 is described below with reference to FIG. 2.

The intermediate transfer unit 17 includes the intermediate transfer belt 110, a belt cleaning device 90, a tension roller 14, a driving roller 15, a backup roller 16, and four primary-transfer bias rollers 62 (62Y, 62M, 62C, and 62K). The intermediate transfer belt 110 is entrained taut around multiple rollers including the tension roller 14 and rotates clockwise in the drawing as the driving roller 15 rotates, driven by a belt driving motor.

The four primary-transfer bias rollers 62 are disposed in contact with an inner face of the intermediate transfer belt 110 and receive a primary transfer bias from a power supply. The four primary-transfer bias rollers 62 press the intermediate transfer belt 110 against the photoconductors 1 from the inner circumferential side, forming primary transfer nips therebetween. The primary transfer bias causes a primary-transfer electrical field between the photoconductor 1 and the primary-transfer bias roller 62 in the primary transfer nip. The yellow toner image is transferred from the photoconductor 1Y onto the intermediate transfer belt 110 with the effects of the primary-transfer electrical field and the nip pressure. Subsequently, magenta, cyan, and black toner images are transferred from the photoconductors 1M, 1C, and 1K and superimposed one on another on the yellow toner image. Thus, a superimposed four-color toner image is formed on the intermediate transfer belt 110. The four-color toner image on the intermediate transfer belt 110 is transferred onto a transfer sheet (i.e., a recording medium) in the secondary transfer nip (secondary transfer process). The belt cleaning device 90 is disposed downstream from the secondary-transfer nip in the sheet conveyance direction, pressing against the driving roller 15 via the intermediate transfer belt 110. The belt cleaning device 90 removes toner remaining on the intermediate transfer belt 110 after the secondary transfer process.

The secondary transfer device 22 is described in further detail below. The secondary transfer device 22 is disposed below the intermediate transfer unit 17 in FIG. 2 and includes a conveyor belt 24 looped around two tension rollers 23. The conveyor belt 24 rotates counterclockwise in the drawing as at least one of the two tension rollers 23 rotates. The intermediate transfer belt 110 and the conveyor belt 24 are nipped between the backup roller 16 and the tension roller 23 on the right in the drawing. Thus, the intermediate transfer belt 110 is in contact with the conveyor belt 24, forming the secondary-transfer nip. A secondary transfer bias opposite in polarity to the toner is applied to the tension roller 23 on the right from a power supply. The secondary-transfer bias causes secondary-transfer electrical field in the secondary transfer nip to electrically transfer the four-color toner image from the intermediate transfer belt 110 toward the tension roller 23. Timed to coincide with transferring of the four-color toner image, the registration roller pair 49 forwards the transfer sheet to the secondary transfer nip, and the four-color toner image is secondarily transferred on the transfer sheet.

The sheet feeder 200 disposed below the printer body 100 includes a paper bank 43 in which multiple sheet feeding trays 44 are stacked one on another. Each sheet feeding tray 44 can contain a bundle of transfer sheets. Each sheet feeding tray 44 is provided with a sheet feeding roller 42 pressed against the transfer sheet on the top in the sheet feeding tray 44. As the sheet feeding roller 42 rotates, the sheet is conveyed to a feeding path 46. Multiple pairs of conveyance rollers 47 are disposed along the feeding path 46, and the registration roller pair 49 is disposed at an end portion of the feeding path 46. The transfer sheet is conveyed toward the registration roller pair 49 and then clamped in the nip between the registration roller pair 49.

Meanwhile, in the intermediate transfer unit 17, the four-color toner image on the intermediate transfer belt 110 is transported to the secondary transfer nip as the intermediate transfer belt 110 rotates. The registration roller pair 49 forwards the transfer sheet nipped therein so that the transfer sheet contacts the four-color image in the secondary transfer nip. Thus, the four-color toner image is transferred onto the transfer sheet in the secondary transfer nip, forming a full-color image on the while sheet. As the conveyor belt 24 rotates, the transfer sheet carrying the full-color toner image is discharged from the secondary transfer nip and conveyed to the fixing device 25.

The fixing device 25 includes a belt unit to rotate a fixing belt 26 looped around two rollers as well as a pressure roller 27 pressed against one of the two rollers of the belt unit. The fixing belt 26 and the pressure roller 27 press against each other, forming a fixing nip therebetween, and the transfer sheet conveyed by the conveyor belt 24 is clamped in the fixing nip. A heat source is disposed inside the roller against which the pressure roller 27 presses to heat the fixing belt 26. Being pressed, the fixing belt 26 heats the transfer sheet nipped in the fixing nip. With the heat and the nip pressure, the full-color toner image is fixed on the transfer sheet (fixing process). After the fixing process, discharge rollers 56 discharge the transfer sheet to a stack tray 57 protruding, to the left in the drawing, from the housing of the apparatus. Alternatively, the transfer sheet is conveyed again to the secondary transfer nip for duplex printing.

To make copies of a bundle of documents, users place the bundle of documents, for example, on a document table 30 of the ADF 400. If the bundle of documents is bound like a book on one side (side-stitched documents), the bundle is placed on an exposure glass 32. Specifically, the user lifts the ADF 400 to expose the exposure glass 32 of the scanner 300, sets the bundle on the exposure glass 32, and then lowers the ADF 400 so as to hold the bundle with the ADF 400.

Then, the user presses a copy start switch, and the scanner 300 starts reading image data of the documents. When the documents are set on the ADF 400, the ADF 400 automatically conveys the documents to the exposure glass 32 before reading the image data.

In reading of image data, the first and second carriages 33 and 34 start moving, and the first carriage 33 directs an optical beam from the light source onto the document. Subsequently, the optical beam reflected from a surface of the document is reflected by the mirror of the second carriage 34, passes through the imaging forming lens 35, and then enters the reading sensor 36. Thus, the reading sensor 36 captures the image data of the document. In parallel to reading of image data, components of the process cartridges 18 (18Y, 18M, 18C, and 18K), the intermediate transfer unit 17, the secondary transfer device 22, and the fixing device 25 start operating. According to the image data obtained by the reading sensor 36, the optical writing unit 21 is driven, and yellow, magenta, cyan, and black toner images are formed on the photoconductors 1Y, 1M, 1C, and 1K, respectively. These toner images are superimposed on the intermediate transfer belt 110 into a four-color toner image.

Almost simultaneously with the start of image data reading, the sheet feeder 200 starts feeding sheets. Specifically, one of the sheet feeding rollers 42 is selectively rotated, and the sheets are fed from the corresponding sheet feeding tray 44. The sheets are fed one by one to the feeding path 46, separated by a separation roller 45, after which the pairs of conveyance rollers 47 convey the sheet to the secondary transfer nip. Instead of the sheet feeding tray 44, the transfer sheets may be fed from a side tray 51 (i.e., a bypass tray) projecting from the side of the printer body 100. In this case, a sheet feeding roller 50 is rotated to feed the sheets from the side tray 51, and a separation roller 52 forwards the sheets one by one to a feed path 53 inside the printer body 100.

When multicolor toner images are formed, the intermediate transfer belt 110 is disposed with its upper portion substantially horizontal so that the photoconductors 1Y, 1M, 1C, and 1K are in contact with the upper side of the intermediate transfer belt 110. By contrast, to form monochrome images (black toner images), the left side of the intermediate transfer belt 110 in the drawing is lowered, thus disengaging the intermediate transfer belt 110 from the photoconductors 1Y, 1M, and 1C. Then, only the photoconductor 1K among the four photoconductors 1 is rotated counterclockwise in the drawing. At that time, not only the photoconductors 1Y, 1M, and 1C but also the developing devices 4Y, 4M, and 4C are stopped to prevent wear of the photoconductors 1Y, 1M, and 1C and waste of developer.

The image forming apparatus 500 further includes a controller including a central processing unit (CPU) and the like, for controlling respective parts thereof and a control panel including a liquid crystal display, various keys, and the like. Regarding simplex printing to form an image on one side of the sheet, the image forming apparatus 500 can offer three different modes: a direct discharge mode, a reverse discharge mode, and a reverse decal discharge mode. The user can select one of the modes by sending a command to the controller from the control panel.

Figure 6:
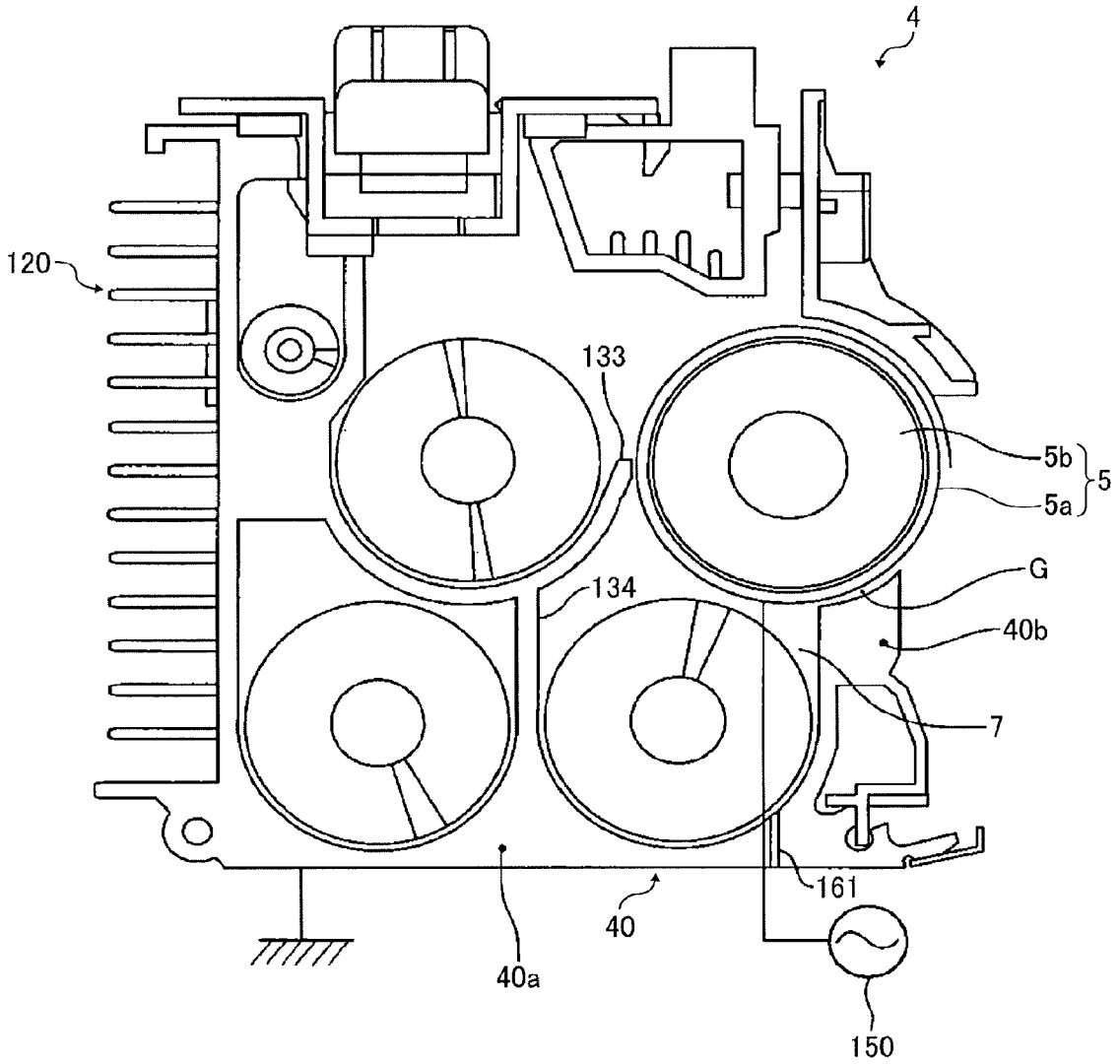
FIG. 6 is a schematic end-on axial view of the developing device illustrated in FIGS. 1A and 1B.

FIG. 6 is a schematic cross-sectional view of the developing device 4.

The casing 40 includes the developer containing compartment 40*a* to contain developer and a gap retainer 40*b* is disposed downstream from the developing range in the rotation direction of the developing roller 5 and secures a predetermined gap (a casing gap G) from the developing roller 5. The developer containing compartment 40*a* is made of metal, such as aluminum, and formed by monolithic molding. That is, the first partition 133, the second partition 134, the heat dissipating part 120, and the like are formed as a single piece. The developer containing compartment 40*a* is electrically grounded. The gap retainer 40*b* is made of an insulative resin material. The gap retainer 40*b* faces the second partition 134 and serves as a wall of the collecting compartment 7. The gap retainer 40*b* defines the casing gap G to introduce the developer borne on the developing roller 5 into the developer containing compartment 40*a*.

In the developing range, the developer borne on the developing roller 5 is temporarily transported outside the developer containing compartment 40*a*. Developer is borne on the developing roller 5 with magnetic force and electrostatic force and collected inside the developer containing compartment 40*a* after passing through the developing range. However, due to the centrifugal force caused by the rotating developing sleeve 5*a*, a part of developer leaves the developing roller 5 and is scattered. To suppress scattering of developer, generating sucking-in airflow in the casing gap G is advantageous. The sucking-in airflow is flow of air moving into the developer containing compartment 40*a*. The sucking-in airflow is generated when developer is transported together with air into the developer containing compartment 40*a*, as the developing sleeve 5*a* rotates, in the arrangement in which the gap retainer 40*b* is disposed opposite the developing roller 5 across a small gap, in a predetermined area. The developer leaving the developing roller 5, which is about to scatter otherwise, rides on the sucking-in airflow and is conveyed into the developer containing compartment 40*a*. Thus, the developer does not scatter outside the developer containing compartment 40*a* but is collected therein.

The above-described sucking-in airflow is generated by flow of the magnetic brush of developer borne on and transported by the developing roller 5. If the distance between the magnetic brush and the gap retainer 40*b* is too large, it is difficult to generate the sucking-in airflow entirely in the casing gap G1, and the effect to suppress scattering of developer becomes insufficient. Adjacent to the surface of the magnetic brush, the flow of developer causes the flow of air in the direction identical to the direction of flow of developer. However, an internal pressure of the developer containing compartment 40*a*, increased by the sucking-in airflow increases, is released through the gap between the magnetic brush and the gap retainer 40*b*. Thus, in suppressing scattering of developer, preferably, the magnetic brush of developer is in contact with the gap retainer 40*b*.

The gap retainer 40*b* is attached to the bottom of the developer containing compartment 40*a* and slidable vertically in FIG. 6. The gap retainer 40*b* also serves as a gap adjuster for adjusting the casing gap G. Specifically, a lower portion of the gap retainer 40*b* (i.e., the gap adjuster) has adjustment slots 131 extending vertically in FIG. 6. A screw 136 is inserted in the adjustment slot 131 to secure the gap retainer 40*b* to the developer containing compartment 40*a*. To adjust the casing gap G to a predetermined size (distance to the developing roller 5), the screw 136 is loosened to allow the gap retainer 40*b* to slide vertically. Thus, the adjustment slots 131 serve as an adjusting portion.

In another embodiment, the gap retainer 40*b* is permanently fixed to the developer containing compartment 40*a* by swaging or bonding. By contrast, in the configuration in which the gap retainer 40*b* and the developer containing compartment 40*a* are separate components such that the gap retainer 40*b* is screwed to the developer containing compartment 40*a* after the size of the gap G is adjusted by sliding the gap retainer 40*b* relative to the developer containing compartment 40*a*, the following effect can be obtained. Even when dimensional variations of parts are accumulated to vary the casing gap G, the size of the casing gap G can be adjusted during assembly to keep high accuracy.

When the casing gap G is small, sealing effect is enhanced to better keep the toner in the developer containing compartment 40*a*, thereby suppressing scattering of toner from the developer containing compartment 40*a*. A very small gap G, however, disadvantageously discourages the toner (i.e., developer) from leaving the developing roller 5 and causes the developer to move along with the developing roller 5 (i.e., carry-over of developer). The risk of carry-over of developer can be reduced by adjusting the casing gap G to be larger on the upstream side than the downstream side in the rotating direction of the developing roller 5 and improving smoothness of the face of the gap retainer 40*b* opposing the developing roller 5.

In a configuration in which the gap retainer 40*b* made of metal, having conductivity, is disposed close to the developing sleeve 5*a* to a degree to contact the magnetic brush, electric discharge may arise from the developing sleeve 5*a*, to which the developing bias is applied, toward the gap retainer 40*b*. In particular, in the present embodiment as described above, AC bias is used as the developing bias. The peak voltage of 1 kV or higher is required to take advantage of the AC bias development. The voltage used for AC bias development, however, is higher than that in DC bias development, and electric discharge is more likely to arise between the developing sleeve 5*a* and the gap retainer 40*b*. Such electric discharge makes the developing bias insufficient and image developing defective, which results in a substandard image in which the image density is insufficient.

In contrast, in the present embodiment, in which the developer containing compartment 40*a* and the gap retainer 40*b* are separate components, the conductive developer containing compartment 40*a* is disposed at a distance from the developing roller 5. This discourages the developing bias applied to the developing roller 5 from causing the electric discharge directing to the developer containing compartment 40*a*. Additionally, even when, in the casing gap G, the gap retainer 40*b* is disposed as close to the developing sleeve 5*a* as to contact the magnetic brush of the developing roller 5, electric discharge does not occur between the insulating gap retainer 40*b* and the developing roller 5. With this configuration, while suppressing the scattering of developer through the casing gap G by the sucking-in airflow created by the magnetic brush, decreases in the developing bias is inhibited. Moreover, a strong electric field is not generated in the casing gap G, and the toner is inhibited from electrostatically adhering to the gap retainer 40*b* at the casing gap G. This suppresses accumulation of toner on the gap retainer 40*b*, and thus inconveniences caused by accumulated toner (for example, leakage of toner to the outside of the device and discouraging of the sucking-in airflow) can be suppressed.

The developer containing compartment 40*a* made of metal is advantageous in efficiently conducting, to the heat dissipating part 120, the heat generated by friction between the developer conveyors and the developer, which arises when the developer conveyors are driven, and friction among developer particles. The heat can be effectively released from the developing device 4 with the heat dissipating part 120, thereby suppressing temperature rise inside the developing device 4. As a result, decreases in the charge amount of toner caused by the temperature rise in the developing device 4 are suppressed, and toner is inhibited form being fused and from adhering to the developer doctor 12 or the developing roller 5. Thus, degradation of image quality is inhibited.

The developer containing compartment 40*a* is made of metal to have conductivity and is electrically grounded, which attains the following effects. If the developer containing compartment 40*a* is made of an insulative material such as resin, it is possible that electrical charges of charged developer charge up the developer containing compartment 40*a*, resulting in image failure. For example, the charged developer containing compartment 40*a* attracts the toner circulating therein and causes the toner to adhere to a wall face thereof. When the toner falls from the developer containing compartment 40*a* and is used in image developing, spots appear in images, or toner is partly absent in images like white dots. Additionally, in a configuration in which the intermediate transfer belt 110 is situated below the developing device 4, it is possible electrical force acts between the charged developer containing compartment 40*a* and the toner image on the intermediate transfer belt 110. Such electrical force can disturb the toner image on the intermediate transfer belt 110, resulting in scattering of toner or fading of the image.

In contrast, the developing device 4 according to the present embodiment has the electrically grounded developer containing compartment 40*a* made of conductive metal, such as aluminum, which prevents the aforementioned inconvenience caused by the accumulated charge on the developer containing compartment 40*a*.

An elastic seal 161 made of (or including) sponge, for example, is disposed between the gap retainer 40*b* and the developer containing compartment 40*a*. The elastic seal 161 prevents the developer in the collecting compartment 7 from leaking outside through a gap between the gap retainer 40*b* and the developer containing compartment 40*a*. A duct 140 is attached to the gap retainer 40*b* to suck in the scattered developer. The duct 140 has a plurality of suction ports and a suction device such as a pump. The suction device generates a sucking-in airflow in the duct 140 to collect the scattered toner through the suction ports into the duct 140. The scattered toner collected in the duct 140 is stored in a collected-toner container inside the apparatus.

Figure 7:
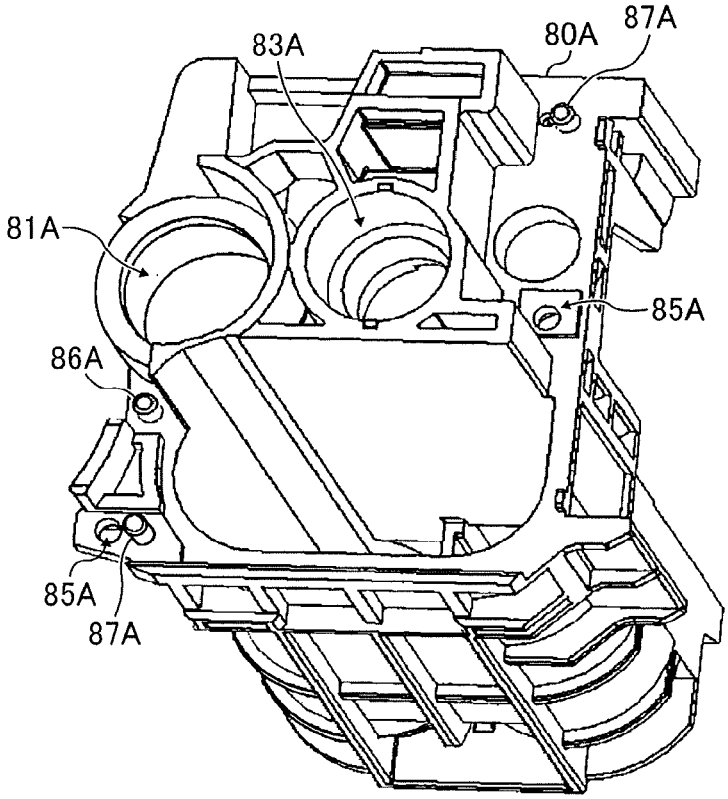
FIG. 7 is a perspective view of the front plate, which is disposed on the front side of a casing of the developing device illustrated in FIGS. 1A and 1B, as viewed from the center side of the developing device.
Figure 8:
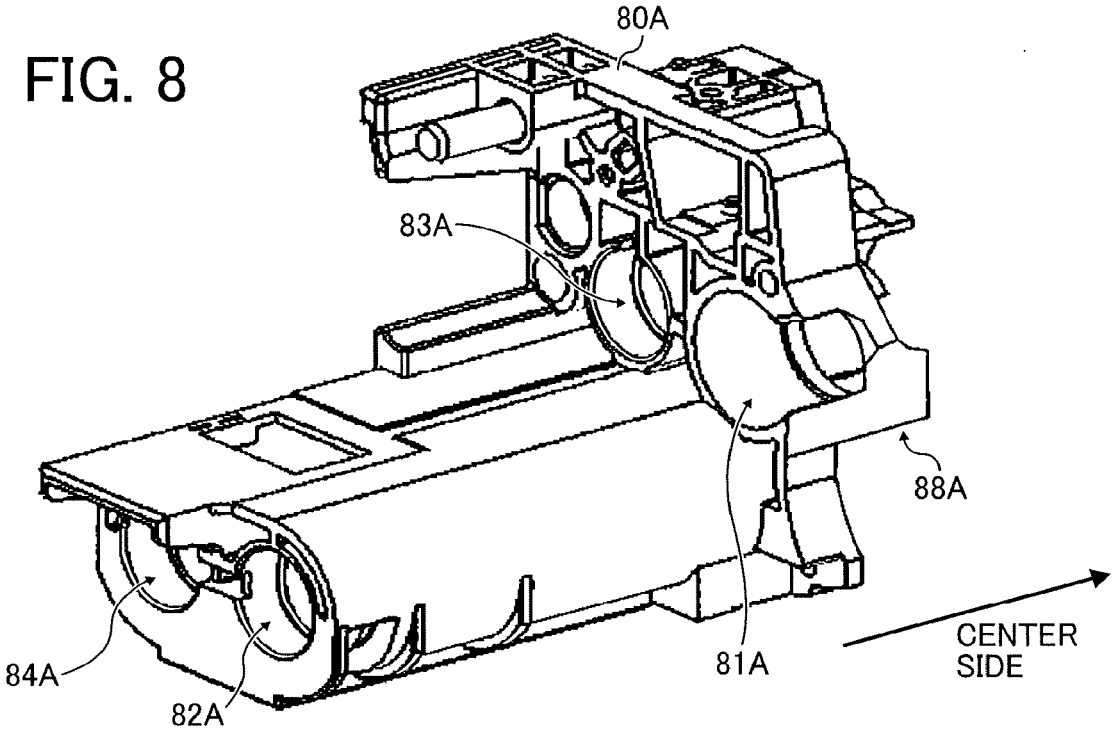
FIG. 8 is a perspective view of the front plate attached to the front side of the casing, viewing from the front side.
Figure 9:
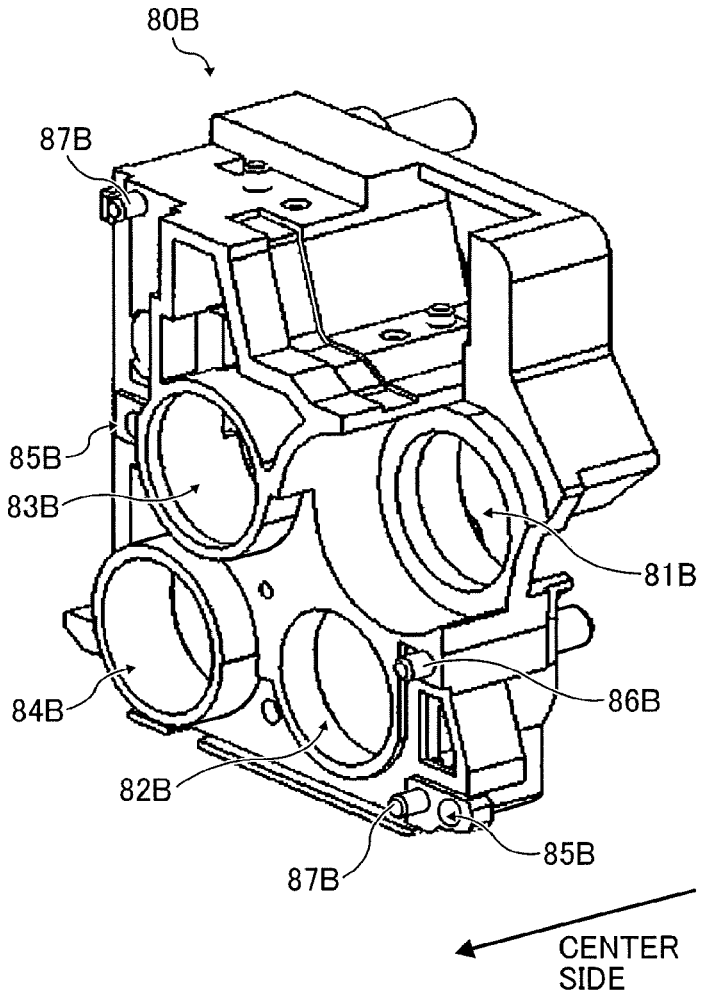
FIG. 9 is a perspective view of the back plate, which is disposed on the other side (back side) of the developer containing compartment, as viewed from the center side of the developing device.

FIG. 7 is a perspective view of the front plate 80A, which is disposed on the front side of the casing 40 defining the developer containing compartment 40*a*, as viewed from the center side of the developing device 4. FIG. 8 is a perspective view of the front plate 80A as viewed from the front side. FIG. 9 is a perspective view of the back plate 80B, which is disposed on the other side (back side) of the casing 40 defining the developer containing compartment 40*a*, as viewed from the center side of the developing device 4. In FIG. 8, arrow A2

The front plate 80A (i.e., an opposing wall) and the back plate 80B are separate components from the casing 40 and have capabilities to support the developing roller 5, the collecting screw 6, the supply screw 8, and the stirring screw 11 rotatably via bearings.

Alternatively, the casing 40 and at least one of the front plate 80A and the back plate 80B can be molded as a single piece. The front plate 80A and the back plate 80B are molded with resin and have hollow portions in which the bearings are inserted. An inner face enclosing the hollow defines bearing insertion portions (i.e., bearing engagement portions). The bearing insertion portions include bearing insertion portions 81 (81A and 81B) for the developing roller 5, bearing insertion portions 82 (82A and 82B) for the collecting screw 6, bearing insertion portions 83 (83A and 83B) for the supply screw 8, and bearing insertion portions 84 (84A and 84B) for the stirring screw 11. The bearings are fitted in the respective bearing insertion portions by press fit and secured to the front plate 80A and the back plate 80B. Then, the positions of the developing roller 5, the collecting screw 6, the supply screw 8, and the stirring screw 11 are determined relative to the front plate 80A and the back plate 80B. Simultaneously, the relative positions of the developing roller 5, the collecting screw 6, the supply screw 8, and the stirring screw 11 are determined.

The front plate 80A and the back plate 80B are screwed to both ends (in the longitudinal direction) of the developer containing compartment 40*a*. The front plate 80A has two screw holes 85A (disposed at different positions) via which the front plate 80A is screwed to the developer containing compartment 40*a*. The back plate 80B has two screw holes 85B via which the back plate 80B is screwed to the developer containing compartment 40*a*. Further, the front plate 80A and the back plate 80B have two positioning projections 87A (disposed at different positions) and two positioning projections 87B (disposed at different positions), respectively, via which the front plate 80A and the back plate 80B are positioned on the developer containing compartment 40*a*. The positioning projections 87A and 87B have almost circular (may be polygonal) cross sections and project to the center side of the developing device 4. Below the bearing insertion portions 81A and 81B for the developing roller 5, positioning projections 86A and 86B are disposed to position the gap retainer 40*b*. The positioning projections 86A and 86B have almost circular (may be polygonal) cross sections and project to the center side of the developing device 4.

Figure 10:
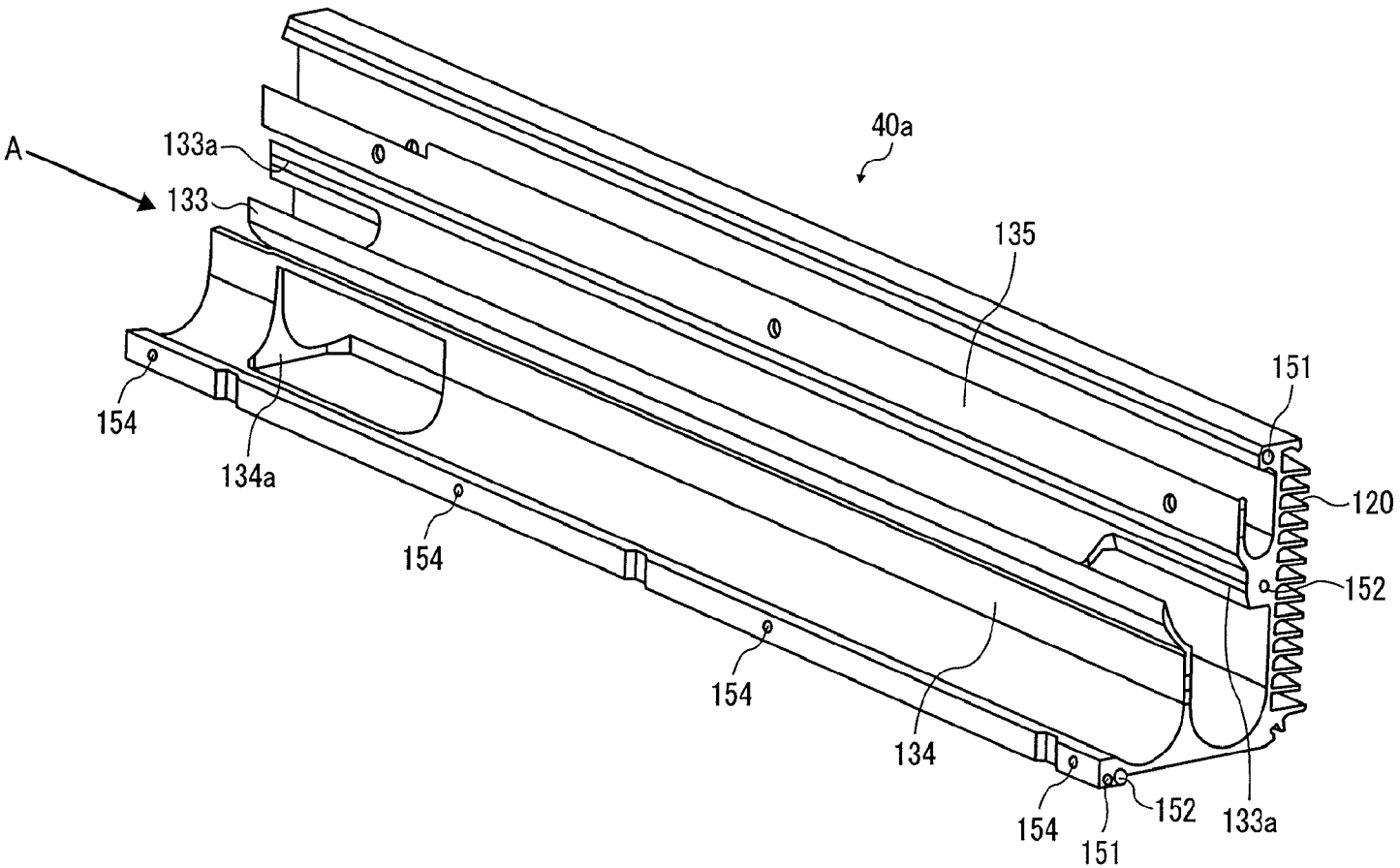
FIG. 10 is a perspective view of the casing of the developing device.

FIG. 10 is a perspective view of the developer containing compartment 40*a*. The developer containing compartment 40*a* is made of metal, such as aluminum, and includes the first partition 133, the second partition 134, and the heat dissipating part 120. As illustrated in FIG. 3, the heat dissipating part 120 includes multiple radiating fins each extending in the longitudinal direction (the axial direction of the developing roller 5). In the end face of the developer containing compartment 40*a* on the back side (rear side), two threaded screw holes 152 are provided to secure the back plate 80B by screwing. Additionally, two positioning holes 151, in which positioning projections 87B of the back plate 80B fit, are provided. In the end face of the developer containing compartment 40*a* on the front side, two screw holes for securing the front plate 80A by screwing and two positioning holes 151, in which positioning projections 87A of the front plate 80A fit, are provided. Four wall-securing screw holes 154, via which the gap retainer 40*b* are screwed to the developer containing compartment 40*a*, are formed in the face (extending in the roller axial direction) of the developer containing compartment 40*a* opposing the photoconductor 1. The four wall-securing screw holes 154 are disposed at intervals in the longitudinal direction.

Figure 11:
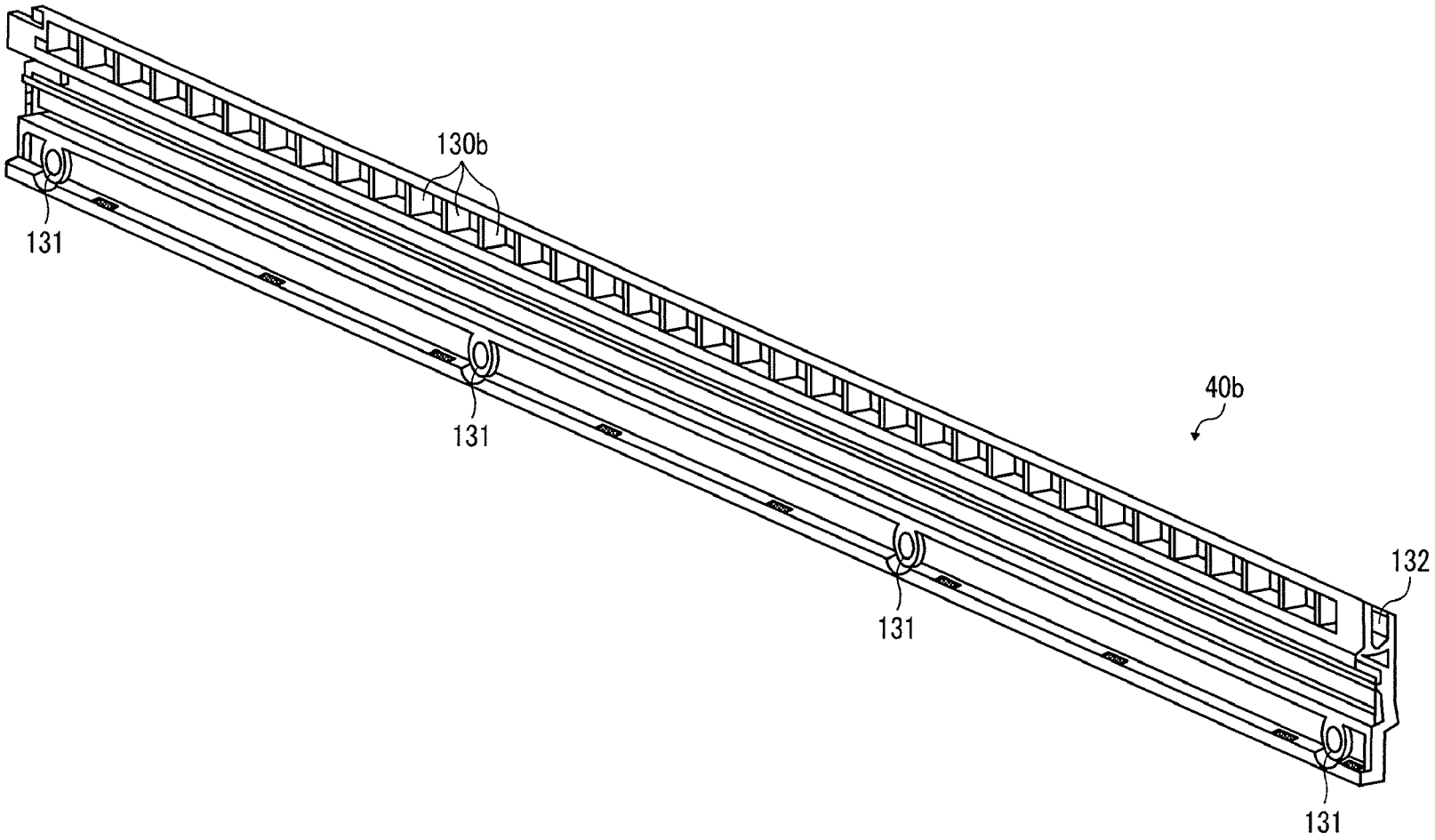
FIG. 11 is a perspective view of a gap retainer of the developing device illustrated in FIGS. 1A and 1B.

FIG. 11 is a perspective view of the gap retainer 40*b*. The gap retainer 40*b* has the four adjustment slots 131, which extends vertically and evenly spaced in the longitudinal direction. With the adjustment slots 131, the casing gap G is adjusted. The gap retainer 40*b* further includes positioning grooves 132 disposed at both longitudinal ends of the gap retainer 40*b*. The gap retainer 40*b* is formed of resin by injection molding. A surface sink produced during injection molding may cause the gap retainer 40*b* to warp in a direction perpendicular to the wall face. The gap retainer 40*b* has a plurality of ribs 130*b* to prevent such a warp. The ribs 130*b* strengthen the gap retainer 40*b* to inhibit deformation and equalize the thickness to inhibit the occurrence of such a sink.

Figure 1B:
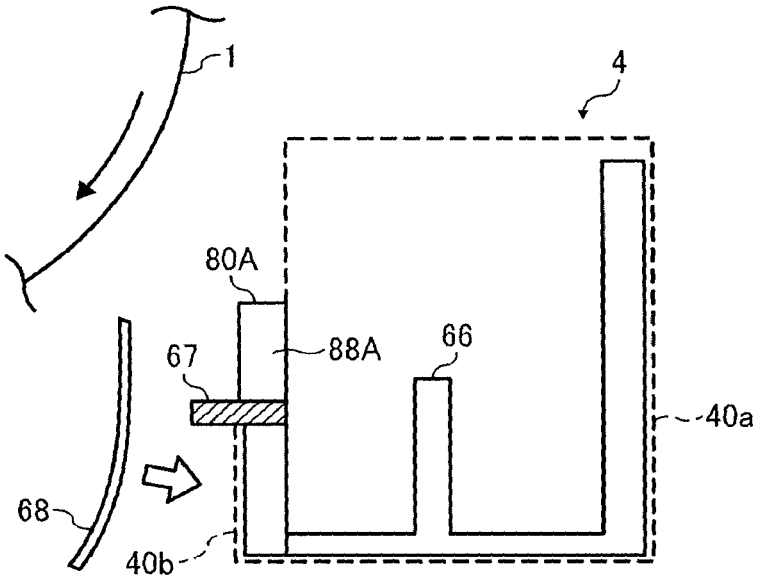
FIG. 1B is a schematic diagram illustrating the seal structure adjacent the front plate of the developing device according to the embodiment, as viewed from a center side in the axial direction of a developing roller.

FIG. 1A is a schematic diagram illustrating a seal structure adjacent to the front plate 80A of the developing device 4 according to the present embodiment, viewing from the photoconductor 1. FIG. 1B is a schematic diagram illustrating the seal structure adjacent to the front plate 80A, as viewed in the direction from the center side in the axial direction of the developing roller 5 to the front plate 80A.

Figure 12:
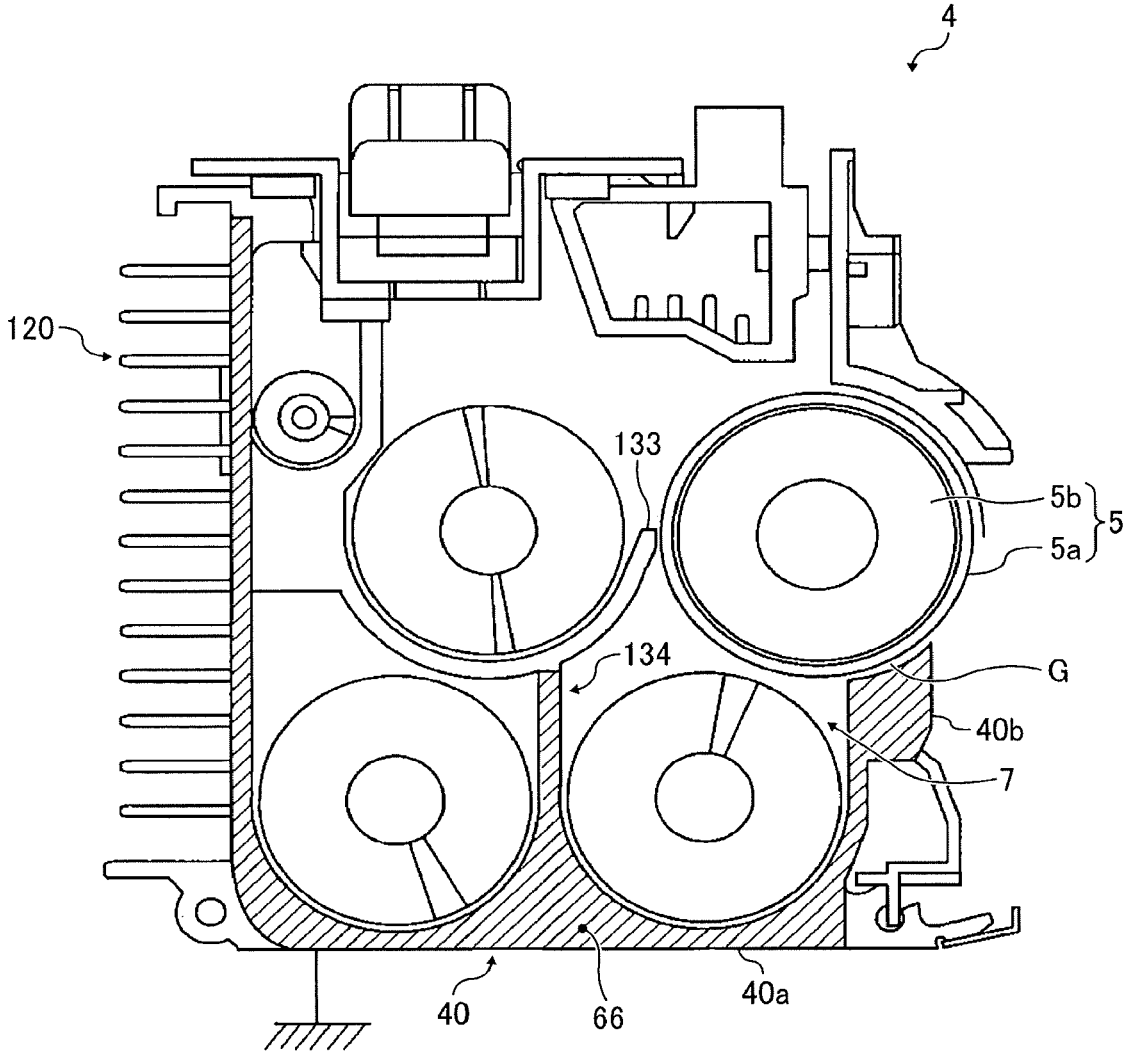
FIG. 12 is a schematic diagram illustrating the shape of an end face seal that contacts the casing of the developing device.

FIG. 12 is a schematic diagram illustrating a shape of an end face seal 66 (a first seal) that contacts the casing 40.

The end face of the gap retainer 40*b* on the front side in the axial direction of the developing roller 5 is hereinafter referred to as "front end face" of the gap retainer 40*b*. As illustrated in FIG. 1A, the developing device 4 according to the present embodiment includes the end face seal 66 provided at least between the front end face of the gap retainer 40*b* and the front plate 80A. The end face seal 66 (i.e., first seal) seals the gap between the front end face of the gap retainer 40*b* and the front plate 80A (i.e., the opposing wall). In the present embodiment, the end face seal 66 is bonded to the back side (i.e., inner face) of the front plate 80A, which faces the center side in the axial direction (indicated by arrow A1 in FIG. 1A) of the developing roller 5, and has a shape corresponding to the front end face of the developer containing compartment 40*a* and the front end face of the gap retainer 40*b*, as illustrated in FIG. 12. Hereinafter, "axial direction of the developing roller 5" may be simply referred to as "roller axial direction". As the front end face of the gap retainer 40*b* bites into the end face seal 66, variations in the sealing capability, caused by dimensional errors of the gap retainer 40*b* in the roller axial direction, can be reduced. In another embodiment, the end face seal 66 is also used for positioning of the gap retainer 40*b* in the axial direction of the developing roller 5, relative to the developer containing compartment 40*a* in the casing 40.

Figure 13:
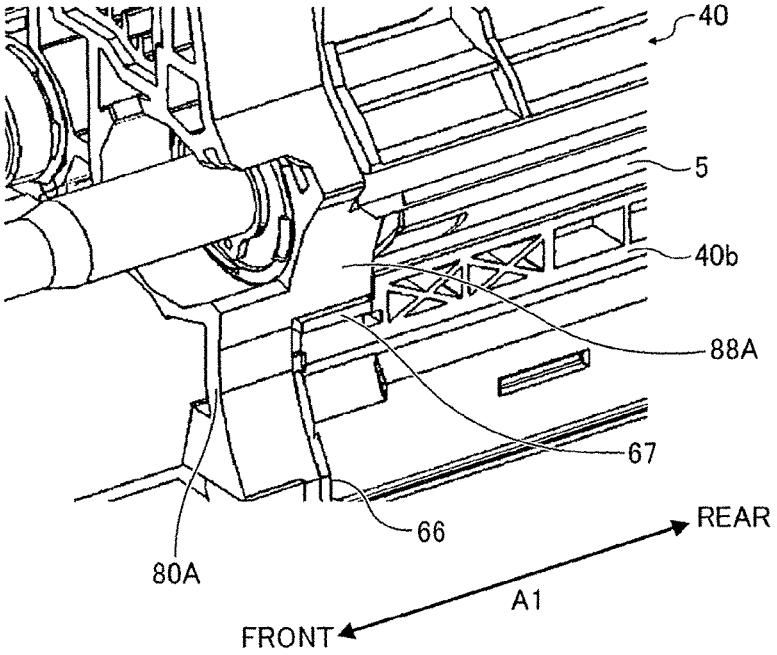
FIG. 13 is an enlarged perspective view of the front side of the developing device.

FIG. 13 is an enlarged perspective view illustrating a region around the front plate 80A of the developing device 4. In the developing device 4 according to the present embodiment, the front plate 80A includes a contact portion 88A. The contact portion 88A contacts a front end portion of the gap retainer 40*b* via a lateral end seal 67 (i.e., a second seal) made of a sponge plate. The contact portion 88A contacts the front end portion of the gap retainer 40*b* in a direction intersecting the roller axial direction. That is, the contact portion 88A contacts, via the lateral end seal 67, a face of the gap retainer 40*b* different from the front end face of the gap retainer 40*b*. The direction in which the contact portion 88A contacts the gap retainer 40B can be, but is not necessarily, perpendicular to the roller axial direction. The contact portion 88A extends, at a predetermined angle, from the opposing wall (e.g., the front plate 80A) opposing the front end face of the gap retainer 40*b*. The contact portion 88A receives the front end portion of the gap retainer 40*b*, via the lateral end seal 67, in the direction perpendicular to the roller axial direction (that is, along the roller axial direction). The lateral end seal 67 seals the gap between the front end portion of the gap retainer 40*b* and the contact portion 88A of the front plate 80A. That is, in the developing device 4 according to the present embodiment, the gaps between the casing 40 and the front plate 80A in the roller axial direction and the direction perpendicular to the roller axial direction are sealed by the end face seal 66 and the lateral end seal 67. Accordingly, leakage of the developer is more effectively prevented compared with a case where only the end face seal 66 seals the gap between the casing 40 and the front plate 80A and the gap between the casing 40 and the back plate 80B.

It is to be noted that the front end portion of the gap retainer 40*b*, which abuts against the contact portion 88A of the front plate 80A, is an end face facing the axial direction of the developing roller 5. In another embodiment, the contact portion 88A is inclined relative to the axial direction of the developing roller 5 to receive the front end portion of the gap retainer 40*b* via the lateral end seal 67. That is, the contact portion 88A is configured such that the front end portion of the gap retainer 40*b* contacts the contact portion 88A via the lateral end seal 67 in the direction intersecting the roller axial direction. The intersecting direction is such that a line perpendicular to the face of the contact portion 88A intersects a virtual plane including the axis of the developing roller 5.

Figure 14:
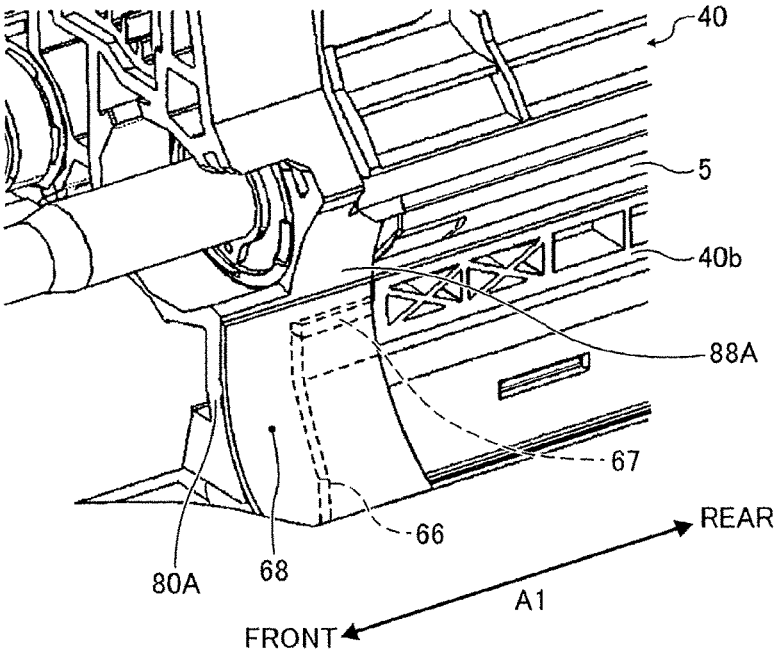
FIG. 14 is an enlarged perspective view illustrating a region around the front plate of the developing device provided with a side seal according to an embodiment.

FIG. 14 is an enlarged perspective view illustrating a region around the front plate 80A of the developing device 4 including another seal 68 (i.e., a third seal). As illustrated in FIG. 14, the seal 68 made of a plate sponge is bonded to the lateral face (extending in the roller axial direction) of the gap retainer 40*b* and the lateral face of the front plate 80A, both opposing the photoconductor 1. The seal 68 covers the end face seal 66 and the lateral end seal 67, thereby improving the sealing capability. As illustrated in FIG. 1B, the lateral end seal 67 projects toward the photoconductor 1 beyond the faces of the gap retainer 40*b* and the front plate 80A opposing the photoconductor 1. The projecting portion of the lateral end seal 67 is crushed when the seal 68 is attached. This enhances tight contact between the lateral end seal 67 and the seal 68, thereby eliminating a gap between the lateral end seal 67 and the seal 68. The amount by which the lateral end seal 67 projects toward the photoconductor 1 is desirably smaller than or equal to 2 mm. Additionally, it is preferred that at least the projecting portion of the lateral end seal 67 does not include a reinforcing material, such as a mylar sheet, nor a fastening material, such as a double-sided adhesive tape, to secure the lateral end seal 67 (at least one of) the gap retainer 40*b* and the front plate 80A. This allows the projecting portion of the lateral end seal 67 to be crushed easily by the seal 68, thereby improving the sealing capability.

Here, in the upstream end in the conveying direction of developer in the collecting compartment 7, the amount of developer is relatively small because the collecting screw 6 conveys developer to the downstream. By contrast, in the downstream end in the conveying direction of developer in the collecting compartment 7, the amount of developer is large because of the developer conveyed by the collecting screw 6 from the upstream. Further, the pressure is high because the developer is pushed to the downstream end face of the collecting compartment 7. Therefore, the developer is very likely to leak through the gap between the gap retainer 40*b* and the contact portion 88A, which is on the downstream side in the direction in which the collecting screw 6 conveys the developer. Therefore, when the lateral end seal 67 is provided only in the gap between the gap retainer 40*b* and the contact portion 88A located on the downstream side in the developer conveyance direction of the collecting screw 6, the portion where risk of developer leakage is high is sealed with low cost.

It is to be noted that sealing on the side of the back plate 80B can be attained by providing, at least, the end face seal 66 and the seal 68 described above. Needless to say, the back plate 80B may be provided with a contact portion that contacts the back end portion of the gap retainer 40*b*, via a lateral end seal made of a plate sponge, such that the contact portion contacts the gap retainer 40*b* in the direction perpendicular to the roller axial direction. Then, sealing capability can further be improved.

The various aspects of the present specification can attain specific effects as follows.

Aspect A

A developing device, such as a developing device 4, includes a developer bearer, such as the developing roller 5 that carries developer on its surface and rotates about its rotational axis to convey the developer to a developing region opposing the surface of a latent image bearer, such as the photoconductor 1, and a casing, such as a casing 40. In the casing, a developer container (e.g., the developer containing compartment 40*a*) that stores the developer is defined, and the developer bearer is housed. The developing device further includes a gap retainer, such as the gap retainer 40*b* that is positioned downstream from the developing region in the rotation direction of the developer bearer and creates a predetermined gap from a surface of the developer bearer, a first seal, such as the end face seal 66, disposed between an end face of the gap retainer in the axial direction of the developer bearer and an opposing wall opposing the end face of the gap retainer, and a contact portion, such as the contact portion 88A that receives, via a second seal, such as the lateral end seal 67, an end portion of the gap retainer along the direction intersecting the axial direction of the developer bearer, the end portion being an end with respect to the axial direction of the developer bearer of the gap retainer. With this configuration, as described above, leakage of developer is inhibited.

Aspect B

The developing device according to Aspect A further includes a third seal, such as the seal 68 covering the first seal and the second seal. With this aspect, as described in the embodiments, sealing capability is enhanced.

Aspect C

In Aspect B, the second seal includes a projecting portion projecting toward the latent image bearer beyond the end face and the wall opposing the end face. With this aspect, as described above, the second seal and the third seal are in further tight contact, which improves sealing capability.

Aspect D

In the developing device according to Aspect C, the projecting portion of the second seal projects by an amount not greater than 2 mm. With this aspect, as described in the embodiments, sealing capability is secured.

Aspect E

In the developing device according to Aspect C or Aspect D, at least the projecting portion of the second seal includes no reinforcing material for reinforcing the second seal nor fastening material to secure the second seal to at least one of the gap retainer and a shaft supporting plate. As in the embodiment described above, this aspect allows the projecting portion of the second seal to be crushed easily by the third seal, thereby improving sealing capability.

Aspect F

The developing device according to Any one of Aspects A to E further includes a developer conveyor to convey the developer in the axial direction of the developer bearer in the casing. Additionally, the second seal is provided only in a downstream portion in a developer conveyance direction of the developer conveyor. With this configuration, as described above, low cost and improved operability can be achieved.

Aspect G

In the developing device according to any one of Aspects A to F, the developer container storing developer and the gap retainer are separate components, and the gap retainer is made of an insulating material. As described above, this aspect inhibits the occurrence of electrical discharge between the developer bearer and the casing wall.

Aspect H

In the developing device according to Aspect G, the gap retainer is attached to the developer container such that the size of the gap is adjustable. As in the embodiment described above, this aspect keeps the gap with high accuracy.

Aspect I

In Aspect G or Aspect H, the developer container is made of metal, and the developing device further includes a cooler (e.g., the heat dissipating part 120) to cool the developer container. As in the embodiment described above, this aspect suppresses decrease in charging amount of developer caused by temperature rise in the developer container and occurrence of developer melting.

Aspect J

An image forming apparatus includes a latent image bearer and the developing device according to any one of Aspects A through I to develop a latent image on the latent image bearer with developer. As in the embodiment described above, this aspect inhibits leakage of developer and enables preferable image formation.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer bearer to carry, by rotation, developer to a developing range facing a latent image bearer;

a casing including a developer container to contain the developer, and the developer bearer is disposed in the casing;

a gap retainer disposed adjacent to the developer container and downstream from the developing range in a rotation direction of the developer bearer, the gap retainer to secure a predetermined gap between a surface of the developer bearer and the gap retainer;

an opposing wall opposing an end face of the gap retainer in an axial direction of the developer bearer;

a first seal disposed between the end face of the gap retainer and the opposing wall;

a contact portion disposed adjacent to an end portion of the gap retainer in the axial direction of the developer bearer, the contact portion to contact, via a second seal, the gap retainer in a direction intersecting the axial direction of the developer bearer; and a third seal to cover the first seal and the second seal, wherein the second seal includes a projecting portion projecting toward the latent image bearer beyond the end face of the gap retainer and the opposing wall.

2. The developing device according to claim 1, wherein the contact portion extends from the opposing wall and is at a predetermined angle from the opposing wall.

3. The developing device according to claim 1, wherein an amount by which the projecting portion of the second seal projects is not greater than 2 mm.

4. The developing device according to claim 1, wherein the projecting portion is free of a reinforcing material and a fastening material to secure the second seal to at least one of the gap retainer and the contact portion.

5. The developing device according to claim 1, further comprising a developer conveyor to convey the developer in the axial direction of the developer bearer in the casing, wherein the second seal is disposed on a downstream side in a direction in which the developer conveyor conveys the developer.

6. The developing device according to claim 1, wherein the developer container and the gap retainer are separate components, and the gap retainer is made of an insulating material.

7. The developing device according to claim 6, wherein the gap retainer includes an adjusting portion to adjust a distance from the developer bearer to the gap retainer.

8. The developing device according to claim 7, wherein the adjusting portion is a slot extending in a direction in which the gap retainer opposes the developer bearer.

9. The developing device according to claim 6, further comprising a cooler to cool the developer container, wherein the developer container is made of metal.

10. An image forming apparatus comprising:

the latent image bearer to bear a latent image; and the developing device according to claim 1 to develop the latent image with the developer.

* * * * *